United States Patent [19]

Pittaway

[11] Patent Number: 4,494,339

[45] Date of Patent: Jan. 22, 1985

[54] KNIFE SHARPENERS

[75] Inventor: Alan K. Pittaway, High Wycombe, England

[73] Assignee: Wilkinson Sword Limited, High Wycombe, England

[21] Appl. No.: 442,204

[22] Filed: Nov. 16, 1982

[30] Foreign Application Priority Data

Nov. 26, 1981 [GB] United Kingdom ..... 8135702

[51] Int. Cl.[3] ..... B24B 3/54

[52] U.S. Cl. ..... 51/204; 76/82; 30/138

[58] Field of Search ..... 76/82, 88, 86; 51/214, 51/210, 204; 30/138; 211/60 T; 206/372, 349

[56] References Cited

U.S. PATENT DOCUMENTS 2,744,320 5/1956 Palermo ..... 30/138

2,767,530 10/1956 Paldanius ..... 51/214

3,676,961 7/1972 Jackson ..... 51/214

3,889,809 6/1975 McNair ..... 30/138

*Primary Examiner*—Roscoe V. Parker

*Attorney, Agent, or Firm*—John K. Williamson

[57] ABSTRACT

This invention relates to knife sharpeners, and particularly to knife sharpeners of a kind which are incorporated in a holder for the knife in which the knife is placed when not in use.

In such holders the blade sharpener is located so that the action of positioning the knife in the holder, and/or the action of withdrawing the knife from the holder, moves the cutting edge relative to the sharpening device to effect a sharpening action.

The knife sharpener of the present invention is provided with means which are incorporated in the holder for varying the effectiveness of the sharpening device even to the extent of rendering it inoperative.

9 Claims, 2 Drawing Figures

KNIFE SHARPENERS

This invention relates to knife sharpeners, and particularly to knife sharpeners of a kind which are incorporated in a holder for the knife in which the knife is placed when not in use.

In such holders the blade sharpener is located so that the action of positioning the knife in the holder, and/or the action of withdrawing the knife from the holder, moves the cutting edge relative to the sharpening device to effect a sharpening action.

According to the present invention there is provided a knife sharpener comprising a holder for the knife when the knife is not in use, sharpening means for sharpening the cutting edge of the knife as a result of the action of positioning the knife in the holder and/or the action of withdrawing the knife from the holder, and means for selectively varying the effectiveness of the sharpening means in sharpening the cutting edge, even to the extent of rendering the sharpening means ineffective.

The invention further provides a knife sharpener comprising a holder for the knife, sharpening means for sharpening the cutting edge of the knife as the knife is withdrawn from the holder and/or replaced in the holder, and means for selectively varying the pressure of engagement of the cutting edge with the sharpening means to vary the extent of sharpening occurring during withdrawal and/or replacement of the knife.

A further feature of the invention is the provision of means for removing any particles which may adhere to the knife as a result of the sharpening action.

Figure 1:
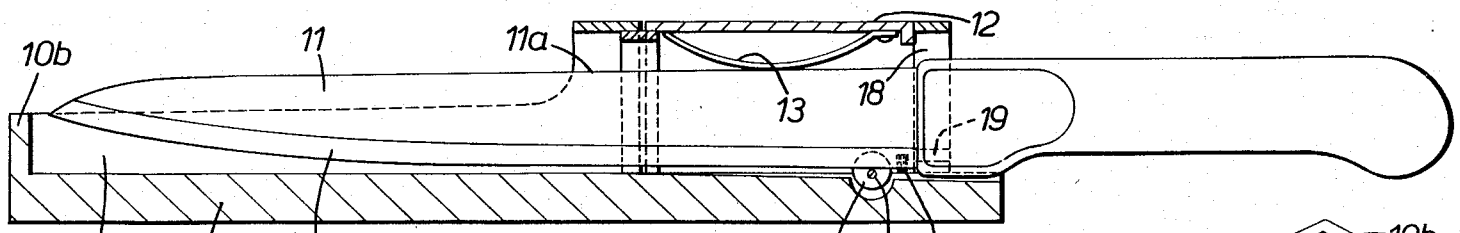
Figure 2:
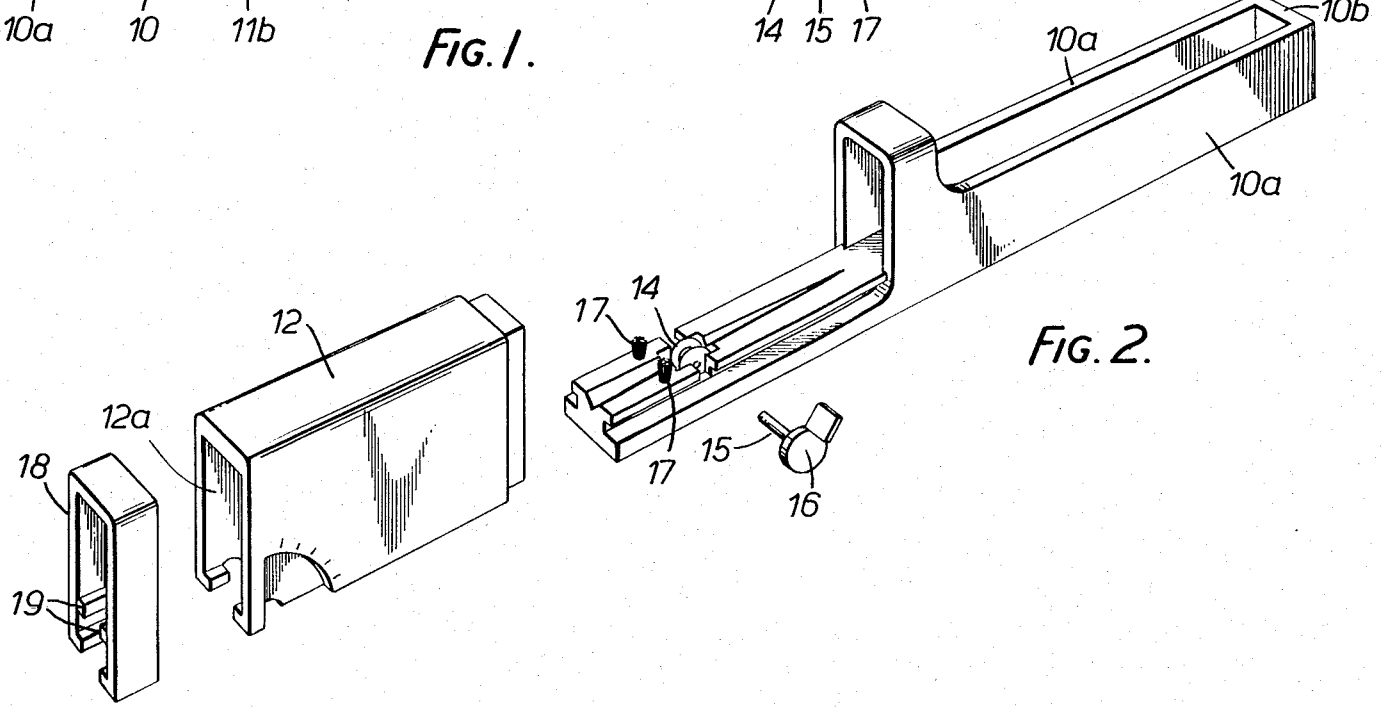

The invention will be better understood from the following description of one construction of knife sharpener in accordance with the invention which will be described, by way of example only, with reference to the accompanying drawings in which:

FIG. 1 is a sectional side elevation of the sharpener with a knife in position, and FIG. 2 is a perspective view of the sharpener prior to assembly.

Referring to the drawings it will be seen that in this embodiment the holder has a base 10 with side walls 10*a* and an end wall 10*b* for accommodating the knife blade 11 which is passed through an opening 12*a* in a housing 12 located towards the end of the holder remote from the end wall 10*b*. A spring 13 is provided in the inside of the upper wall of the housing 12 to engage the non-cutting edge 11*a* of the blade in order to press the blade 11 downwardly. The sharpener is located in the base 10 of the holder within the housing 12, and comprises an abrasive wheel 14, such as of tungsten carbide, formed by two bevelled faces providing a V section groove around the periphery of the wheel 14. The wheel 14 is eccentrically mounted on a spindle 15 which carries an adjusting knob 16. By rotation of the knob 16 the periphery of the wheel 14 is moved progressively upwards or downwards relative to the base 10.

With the knob 16 at one end of its travel the surface of the wheel 14 will not contact the cutting edge 11*b* as it is passed into, the withdrawn through, the housing opening 12*a*. As the knob 16 is turned from this position the surface of the wheel 14 will be progressively raised, increasing the pressure applied by the spring 13 on the upper surface 11*a* of the blade, and causing the pressure between the cutting edge 11*b* and the surface of the wheel 14 to be greater, thereby resulting in an enhanced sharpening action. The engagement of the knob 16 with the housing 12 may be such that the knob 16 is moved in steps in a click-stop action.

An additional optional feature is the provision of means for cleaning particles from the knife during insertion and/or withdrawal of the blade from the holder. Such means may take the form of a pair of brushes 17 mounted on the base 10 to engage respective sides of the cutting edge 11*b* of the blade 11 after it has passed over the sharpener wheel 14 during withdrawal. These brushes 17 will also serve to remove loose particles as the blade 11 is inserted. Additionally, or alternatively, magnetic means may be provided in a removable frame 18 which can be slid onto the base 10 to abut the housing 12, so that any metallic particles remaining on the cutting edge following the sharpening action are attracted from the cutting edge onto the magentic means as the knife is withdrawn. Such magnetic means may, for example, take the form of suitably positioned magnets 19 or by incorporating magnetized particles in a plastic moulding which constitutes the frame 18. In either arrangement the frame 18 may be slid off the base 10, from time to time, to remove metallic particles or other unwanted matter which has accumulated in the frame.

Although the sharpener as described has taken the form of a wheel, it will be appreciated that it may take other suitable forms, for example the generally used crossed bars of abrasive material which could be swung, or raised and lowered, to vary the degree of sharpening.

I claim:

1. A knife sharpener comprising a holder for the knife when the knife is not in use, sharpening means for sharpening the cutting edge of the knife as a result of the action of positioning the knife in the holder and/or the action of withdrawing the knife from the holder, and means for selectively varying the effectivenss of the sharpening means in sharpening the cutting edge, even to the extent of rendering the sharpening means ineffective.

2. A knife sharpener comprising a holder for the knife, sharpening means for sharpening the cutting edge of the knife as the knife is withdrawn from the holder and/or replaced in the holder, and means for disengaging the cutting edge and the sharpening means.

3. A knife sharpener according to either claim 1 or 2, having a housing with an opening therein through which the knife is passed to place it in the holder, said housing having means therein for pressing the cutting edge of the knife into engagement with the sharpening means during passage of the knife through the opening.

4. A knife sharpening according to either claim 1 or 2, having resilient means adapted to press the cutting edge of the knife into engagment with the sharpening means during positioning of the knife in the holder.

5. A knife sharpener according to any one of claims 1 to 2, wherein the sharpening means is rotatable and is mounted eccentrically on its axis of rotation, whereby the degree of engagement between the sharpening means and the cutting edge can be varied by rotation of the sharpening means.

6. A knife sharpener according to any one of claims 1 to 2, wherein the sharpening means is a wheel having a grooved periphery forming opposed faces each adapted to engage a respective face of the knife.

7. A knife sharpener according to any one of claims 1 to 2, comprising means adapted to remove particles from the cutting edge as the knife is removed from the holder.

8. A knife sharpener according to claim 7 wherein the particle removing means comprises a brush.

9. A knife sharpener according to claim 7 wherein the particle removing means is magnetic.

* * * * *